US009516424B2

(12) United States Patent
Schelling et al.

(10) Patent No.: US 9,516,424 B2
(45) Date of Patent: Dec. 6, 2016

(54) MICROMECHANICAL SENSOR SYSTEM COMBINATION AND A CORRESPONDING MANUFACTURING METHOD

(71) Applicant: Robert Bosch GmbH, Stuttgart (DE)

(72) Inventors: Christoph Schelling, Stuttgart (DE); Rolf Scheben, Reutlingen (DE); Ricardo Ehrenpfordt, Korntal-Meunchingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/732,368

(22) Filed: Jun. 5, 2015

(65) Prior Publication Data

US 2015/0365751 A1 Dec. 17, 2015

(30) Foreign Application Priority Data

Jun. 12, 2014 (DE) ..... 10 2014 211 197

(51) Int. Cl.

| | |
|---|---|
| ***H04R 25/00*** | (2006.01) |
| ***H04R 19/00*** | (2006.01) |
| ***H04R 19/04*** | (2006.01) |
| ***H04R 31/00*** | (2006.01) |

(52) U.S. Cl.

CPC ..... *H04R 19/005* (2013.01); *H04R 19/04* (2013.01); *H04R 31/00* (2013.01)

(58) Field of Classification Search

CPC .. H04R 1/08; H04R 19/04; H04R 2201/401; H01L 2924/00; H01L 2924/0132; H01L 24/32

USPC ..... 381/171–175, 150–152; 257/415, 416, 257/417; 73/514.33, 431

See application file for complete search history.

(56) References Cited

U.S. PATENT DOCUMENTS

| | | | | |
|---|---|---|---|---|
| 2009/0101998 | A1 | 4/2009 | Yen et al. | |
| 2010/0052082 | A1 | 3/2010 | Lee et al. | |
| 2010/0086146 | A1 | 4/2010 | Gong et al. | |
| 2011/0057273 | A1 | 3/2011 | O'Donnell et al. | |
| 2012/0235256 | A1 * | 9/2012 | Zoellin | H04R 19/005 257/416 |
| 2013/0147040 | A1 | 6/2013 | Ochs et al. | |

FOREIGN PATENT DOCUMENTS

| | | | | |
|---|---|---|---|---|
| DE | 10 2006 022 379 | | 11/2007 | |
| DE | 10 2012 213 305 | | 1/2014 | |
| DE | 10 2012 220 323 | | 5/2014 | |
| JP | 2012043867 | A * | 3/2012 | |
| JP | WO 2013129389 | A1 * | 9/2013 | H04R 1/085 |
| WO | WO 2006 012 255 | | 2/2006 | |
| WO | WO 2012 122 872 | | 9/2012 | |

* cited by examiner

*Primary Examiner* — Quoc D Tran
*Assistant Examiner* — Julie X Dang
(74) *Attorney, Agent, or Firm* — Norton Rose Fulbright US LLP; Gerard Messina

(57) ABSTRACT

A micromechanical sensor system combination, and a corresponding manufacturing method, includes an interposer chip including a first front side and a first back side which includes first electrical contacts on the first front side and second electrical contacts on the first back side, the interposer chip having first electrical vias which electrically connect the first electrical contacts to the second electrical contacts; as well as a micromechanical sensor chip system including a second front side a second back side including at least one first sensor device and a second sensor device which are laterally adjacent, the first front side being attached on the second front side so that the first sensor device and the second sensor device are electrically and mechanically connected to the first electrical contacts.

15 Claims, 6 Drawing Sheets

MICROMECHANICAL SENSOR SYSTEM COMBINATION AND A CORRESPONDING MANUFACTURING METHOD

RELATED APPLICATION INFORMATION

The present application claims priority to Application No. DE 10 2014 211 197.8, filed in the Federal Republic of Germany on Jun. 12, 2014, which is incorporated herein in its entirety by reference thereto.

FIELD OF THE INVENTION

The present invention relates to a micromechanical sensor system combination and a corresponding manufacturing method.

BACKGROUND INFORMATION

The present invention and its underlying object are explained based on micromechanical microphone/pressure sensor systems, although they are in principle applicable to any arbitrary micromechanical sensor system combinations.

Micromechanical microphone systems usually have a sound transducer which is integrated on an MEMS chip for converting sound energy into electrical energy, in which a first electrode which is deflectable by sound energy and a stationary, perforated second electrode are capacitively interacting. The deflection of the first electrode is determined by the difference between the sound pressures upstream and downstream from the first electrode. If the deflection changes, the capacitance of the capacitor formed by the first and the second electrodes is changed, which is metrologically detectable.

On the back side of the first electrode, a so-called back volume is provided. The size of the back volume determines the sensitivity of the micromechanical microphone system, since a compression in the back volume, in particular in the case of small back volumes, which is caused by the deflection of the first electrode has a damping effect on the deflection of the first electrode.

Micromechanical microphone systems, such as the ones used in mobile devices, in smart phones, for example, are generally available in two design variants, such as from US 2013/0147040 A1, for example.

In the case of the "bottom port" variant, the acoustic access is implemented from the bottom via a printed circuit board. In this case, the MEMS chip including the sound transducer is glued to the printed circuit board and closed using a back cover in order to form the back volume.

In the case of the "top port" variant, the acoustic access takes place from the top; the MEMS chip including the sound transducer is glued into a cover, so that the acoustic access takes place through a port in the cover.

The overall size is playing an increasingly important role for more recent applications, e.g., headsets or electronic eyeglasses. It is important in this case to achieve what may be a large back volume with a minimal base area and overall height, since the back volume significantly contributes to the overall performance of the microphone.

Due to the manufacturing tolerances in the case of the known approaches for the housing, a further miniaturization while maintaining the overall performance is not possible for the time being. In addition, the maximally possible back volume and the maximum size of the access port are not achieved either due to the tolerances.

It is known from DE 10 2006 022 379 A1 to bond an ASIC chip including a back-side cavern on an MEMS chip including a sound transducer in such a way that the back volume is increased by the cavern because it is distributed among both chips.

A wafer level-based packaging concept for MEMS components is from DE 10 2011 005 676 A1, an interposer which has at least one passage opening as the access opening to the MEMS component, e.g., a sound passage opening, being connected to the front side of the MEMS component. The interposer is provided with electrical vias, so that the MEMS component is electrically connectable via the interposer.

SUMMARY OF THE INVENTION

The present invention provides a micromechanical sensor system combination as described herein and a corresponding manufacturing method as described herein.

Refinements are the subject matter of the further descriptions herein.

The micromechanical sensor system combination according to the present invention as described herein and the corresponding manufacturing method as described herein provide for a cost-effective production of a sensor combination, the achievement of minimal external dimensions and—if used for sound transducers—which may be a large back volume, multiple sensor devices being easily coupleable to one another.

According to one refinement, a further chip is situated within the interposer chip. This increases the scale of integration.

According to another refinement, the further chip is at least partially embedded into the interposer chip, the interposer chip including second electrical vias which electrically connect the further chip to the second electrical contacts. In this way, the further chip may also be connected via the interposer chip.

According to another refinement, the further chip is an ASIC chip.

According to another refinement, the further chip has a third sensor device. The sensor system may be further expanded in this way.

According to another refinement, the third sensor device is exposed with regard to a surrounding medium. Additional surroundings parameters may be detected in this way.

According to another refinement, the interposer chip has a hollow space including a first passage opening which is closed off by the first sensor device.

According to another refinement, the hollow space has a lateral widening which extends underneath the second sensor device. This provides a large back volume for a sound transducer, for example.

According to another refinement, the second sensor device is exposed with regard to a surrounding medium by a lateral access which is present between the first front side and the second front side.

According to another refinement, the first sensor device includes a sound transducer, the sensor chip system having a recess on the side facing away from the interposer chip.

According to another refinement, the recess is a sound passage opening for the sound transducer. The sound may be coupled into the back side in this way.

According to another refinement, a second passage opening is provided in the interposer chip as a sound passage opening for the sound transducer. The sound may be coupled into the front side in this way.

According to another refinement, the first sensor device and the second sensor device are integrated on a single sensor chip. This further increases the scale of integration.

According to another refinement, the hollow space has a third passage opening which is closed off by the second sensor device. A shared access may be implemented for both sensor devices in this way.

The present invention is elucidated below in greater detail with reference to the exemplary embodiments indicated in the schematic figures of the drawings.

Identical reference numerals in the figures denote identical elements or elements having an identical function.

DETAILED DESCRIPTION

Figure 1:
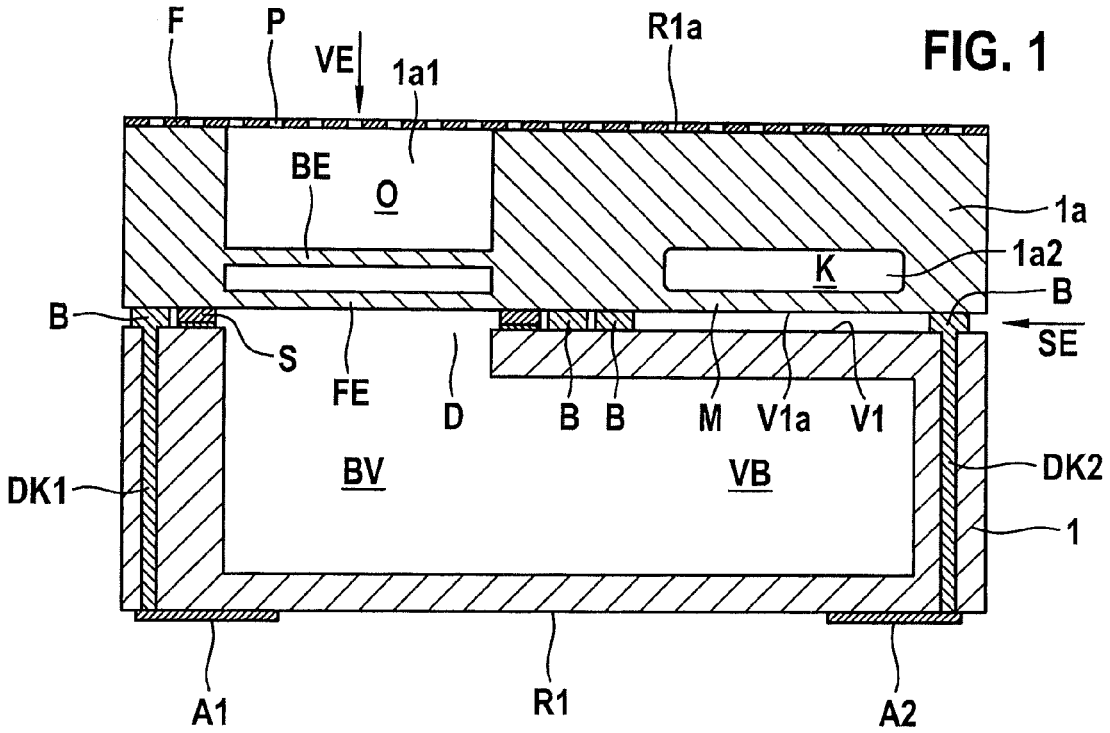
FIG. 1 shows a schematic vertical cross-sectional view of a micromechanical sensor system combination according to a first specific embodiment of the present invention.

FIG. 1 shows a schematic vertical cross-sectional view of a micromechanical sensor system combination according to a first specific embodiment of the present invention.

In FIG. 1, reference numeral 1 identifies an interposer chip including a first front side V1 and a first back side R1 which has first electrical contacts B on first front side V1 and second electrical contacts A1, A2 on first back side R1.

Interposer chip 1 may, for example, be formed from a plastic material, e.g., a printed circuit board substrate, but also from other suitable materials such as glass, semiconductor materials, etc.

In addition to first electrical contacts B and second electrical contacts A1, A2 which function as bonding contacts to a micromechanical sensor chip system 1*a*, on the one hand, and to a carrier substrate (not shown), on the other hand, printed conductors of a rewiring device, which are not illustrated here for the sake of simplification, may be provided on first front side V1 and on first back side R1.

Interposer chip 1 has first electrical vias DK1, DK2 which electrically connect first electrical contacts B to second electrical contacts A1, A2.

Micromechanical sensor chip system 1*a* has a second front side Via and a second back side R1*a*. It is attached by bonding on first front side V1 at second front side V1*a*. Electrical connections of micromechanical sensor chip system 1*a*, which are not illustrated in detail either, are connected to first electrical contacts B, so that the micromechanical sensor chip system is electrically connectable by interposer chip 1 via second electrical contacts A1, A2, without the need of additional electrical contacts.

The mechanical and electrical connection via first electrical contacts B may take place, for example, by flip-chip contacts in the form of stud bumps, solder bumps, solder balls, copper pillars, by soldering, gluing, or welding, etc.

Micromechanical sensor chip system 1*a* has a first sensor device 1*a*1 and a second sensor device 1*a*2, which are laterally adjacent, integrated on a single chip. In the present example, the first sensor device is a sound transducer, e.g., a microphone, and second sensor device 1*a*2 is a pressure sensor.

For this purpose, first sensor device 1*a*1 has a movable electrode BE and a stationary electrode FE. Above movable electrode BE, a recess O which is used as sound passage opening VE for the sound transducer is provided in sensor chip system 1*a*. A protective foil F having perforations P on second back side R1*a* is used to protect recess O and movable electrode BE lying underneath it against particles and other environmental media.

Interposer chip 1 has a hollow space BV including a lateral widening VB so that the hollow space extends underneath first sensor device 1*a*1 and second sensor device 1*a*2.

Furthermore, hollow space BV has a first passage opening D which is closed off by first sensor device 1*a*1 in the form of the microphone, a sealing ring S surrounding passage opening D ensuring soundproofing. In this way, sound reaches movable electrode BE through sound passage opening VE and sets this electrode into mechanical oscillations which may be converted into electrical signals by the capacitive effect of the capacitor formed from movable electrode BE and stationary electrode FE. Hollow space BV including widening VB ensures in this case a large back volume which reduces undesirable damping effects.

The second sensor device in the form of the pressure sensor device is exposed with regard to a surrounding medium above a lateral access SE which is present between first front side V1 and second front side Via so that the external pressure is measurable by being applied to a diaphragm M of second sensor device 1*a*2 which lies above a cavern K.

Figure 2:
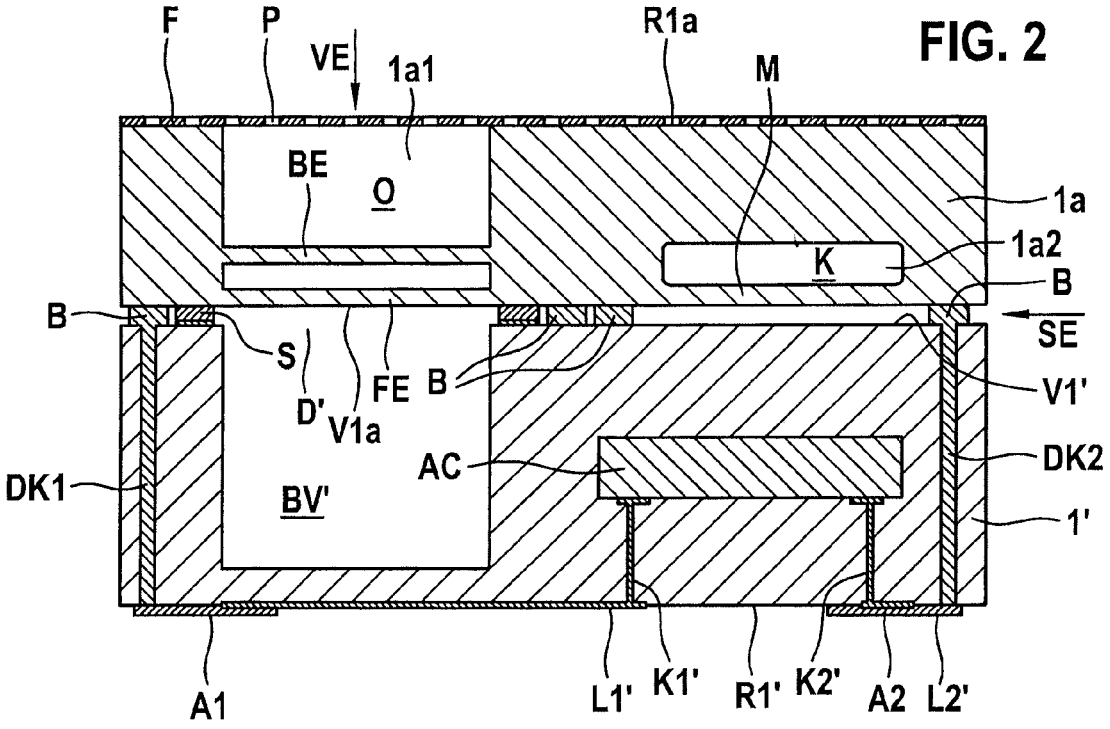
FIG. 2 shows a schematic vertical cross-sectional view of a micromechanical sensor system combination according to a second specific embodiment of the present invention.

FIG. 2 shows a schematic vertical cross-sectional view of a micromechanical sensor system combination according to a second specific embodiment of the present invention.

In the case of the second specific embodiment according to FIG. 2, an interposer chip 1', which is modified as compared to the first specific embodiment, including a first front side V1' and a first back side R1' is provided. This modified interposer chip 1' has a hollow space BV' only underneath first sensor device 1*a*1, this hollow space thus forming a back volume, which is reduced with regard to the first specific embodiment, for the microphone of first sensor device 1*a*1.

In addition, an ASIC chip AC which is completely embedded into interposer chip 1' underneath second sensor device 1*a*2 is provided within interposer chip 1'. This may take place, for example, by remolding or by casting. On the bottom side of ASIC chip AC, second electrical vias K1', K2' are provided which electrically connect ASIC chip AC to second electrical contacts A1, A2, via K1' being connected to electrical contact A1 via an additional printed conductor L1', whereas via K2' is connected directly to electrical contact A2. This implementation makes it possible to accommodate ASIC chip AC in a hermetically packaged and space-saving manner, without the need for more space.

Figure 3:
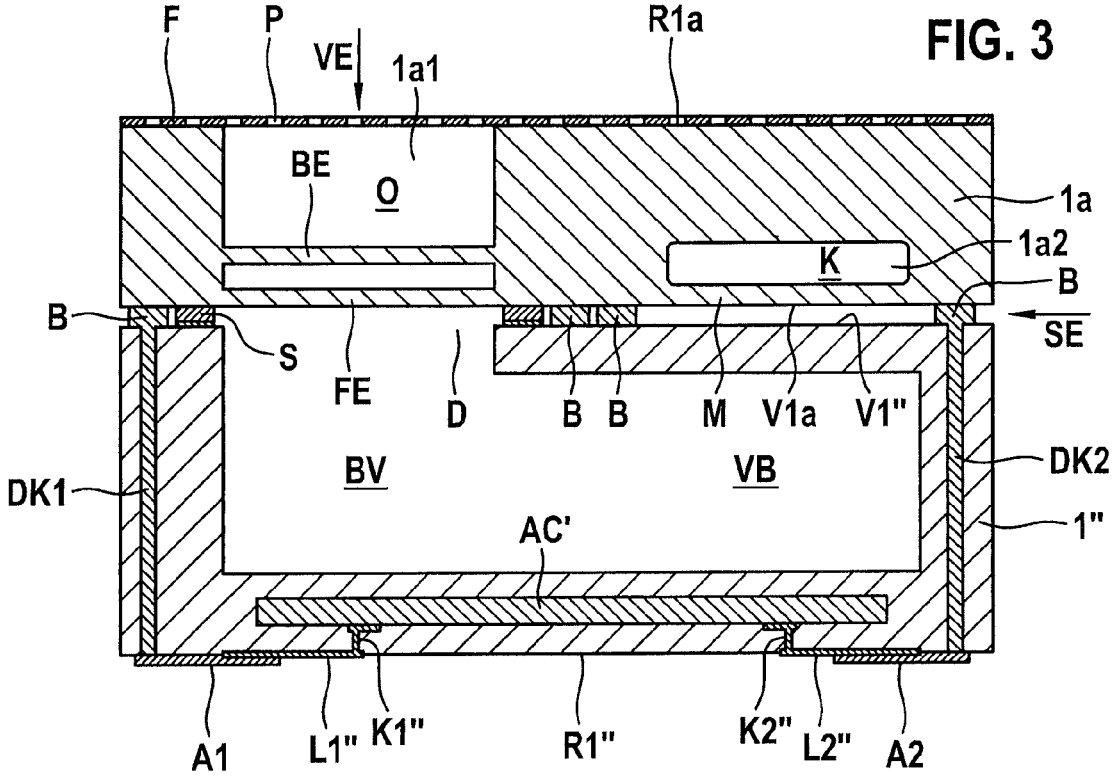
FIG. 3 shows a schematic vertical cross-sectional view of a micromechanical sensor system combination according to a third specific embodiment of the present invention.

FIG. 3 shows a schematic vertical cross-sectional view of a micromechanical sensor system combination according to a third specific embodiment of the present invention.

The third specific embodiment according to FIG. 3 also has an interposer chip 1", which is modified as compared to the first and the second specific embodiments, including a first front side V1" and a first back side R1".

In the case of this interposer chip 1", ASIC chip AC' is embedded into the lower area of interposer chip 1". In this third specific embodiment, it is possible, as in the case of the first specific embodiment, to provide an increased back volume for the microphone of first sensor device 1*a*1 which has hollow space BV including additional widening VB.

Second vias K1", K2" in interposer chip 1" connect ASIC chip AC' to second electrical contacts A1, A2 by the interposition of corresponding printed conductors L1" and L2".

Figure 4:
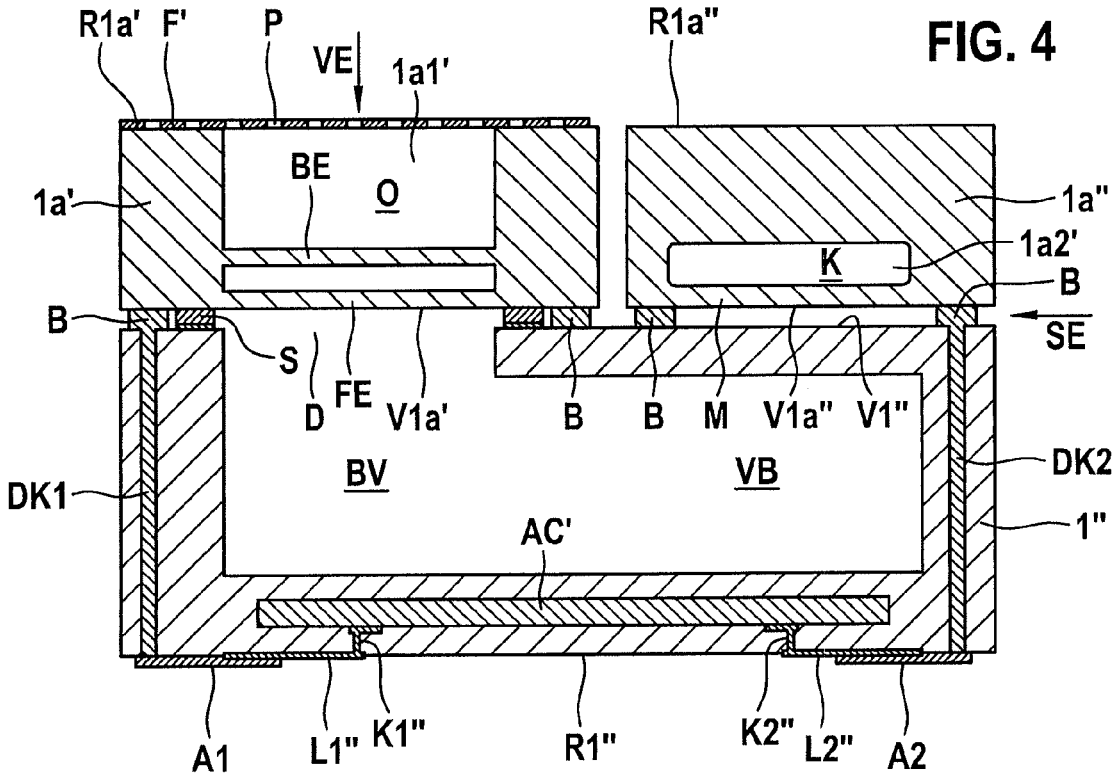
FIG. 4 shows a schematic vertical cross-sectional view of a micromechanical sensor system combination according to a fourth specific embodiment of the present invention.

FIG. 4 shows a schematic vertical cross-sectional view of a micromechanical sensor system combination according to a fourth specific embodiment of the present invention.

In the case of the fourth specific embodiment according to FIG. 4, micromechanical sensor chip system 1*a*', 1*a*" includes two separate sensor chips 1*a*' and 1*a*" in contrast to the third specific embodiment. Sensor chip 1*a*' including second front side Via' and second back side R1*a*' contains first sensor device 1*a*1' in the form of the microphone and is bonded on interposer chip 1" above passage opening D.

Second sensor chip 1*a*" including second front side V1*a*" and second back side R1*a*" contains second sensor device 1*a*2' including the pressure sensor and is bonded laterally at a distance on interposer chip 1".

Figure 5:
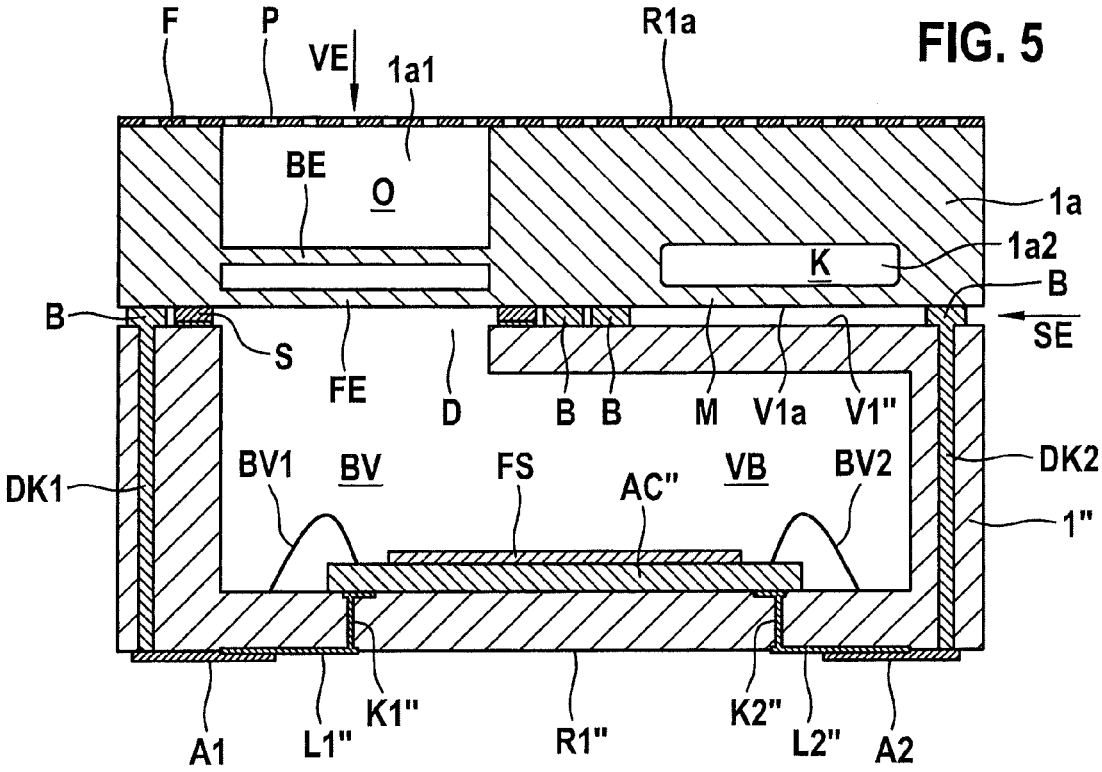
FIG. 5 shows a schematic vertical cross-sectional view of a micromechanical sensor system combination according to a fifth specific embodiment of the present invention.

FIG. 5 shows a schematic vertical cross-sectional view of a micromechanical sensor system combination according to a fifth specific embodiment of the present invention.

In the case of the fifth specific embodiment according to FIG. 5, an ASIC chip AC" is attached, e.g., glued, to the bottom side of hollow space BV including widening VB in contrast to the third specific embodiment.

ASIC chip AC" carries on its front side a third sensor device, e.g., in the form of a humidity sensor FS. ASIC chip AC" is connected within interposer chip 1" via lateral bonding connections BV1, BV2 to a printed conductor system (not illustrated) which is connected to vias K1", K2" in the interior of interposer chip 1", so that this ASIC chip AC" is also electrically connectable via first back side R1".

Humidity sensor FE thus makes it possible to detect the humidity within the back volume of the microphone which is formed by hollow space BV including its widening VB.

Figure 6:
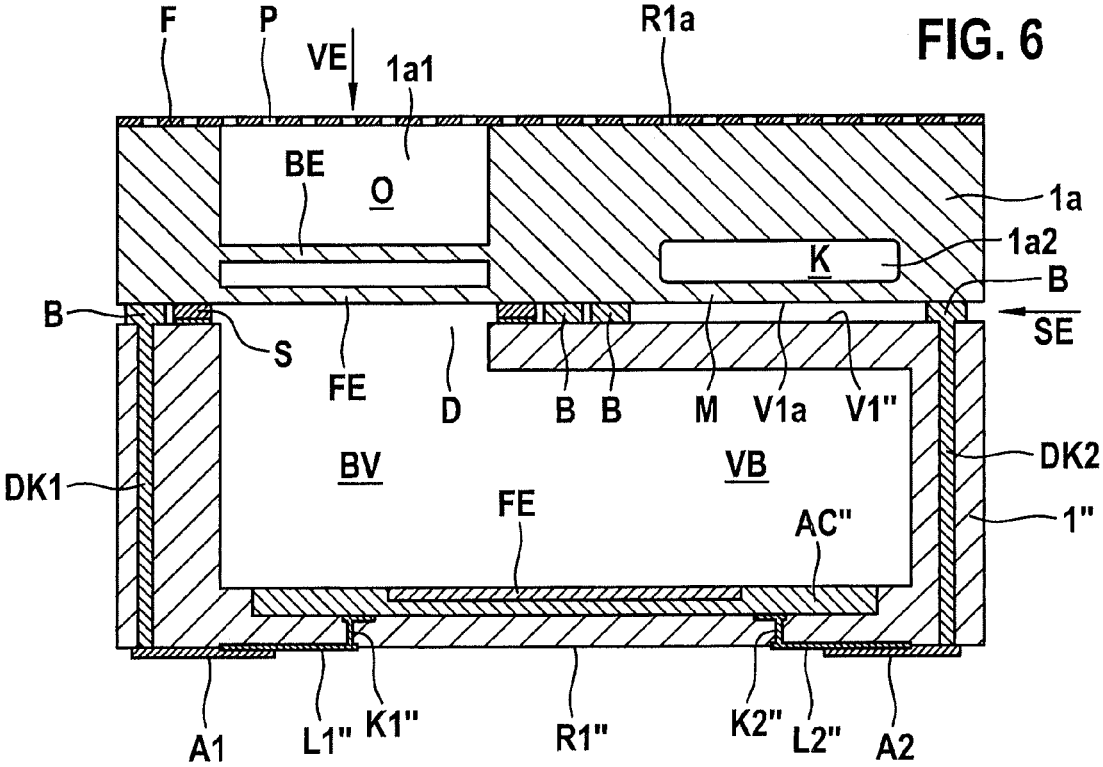
FIG. 6 shows a schematic vertical cross-sectional view of a micromechanical sensor system combination according to a sixth specific embodiment of the present invention.

FIG. 6 shows a schematic vertical cross-sectional view of a micromechanical sensor system combination according to a sixth specific embodiment of the present invention.

In the case of the sixth specific embodiment according to FIG. 6, ASIC chip AC", including humidity sensor FE which is situated on its top side, is partially embedded into interposer chip 1", so that essentially only its top site is exposed toward hollow space BV including widening VB. In addition, humidity sensor FE is embedded into ASIC chip AC".

This results in an increased back volume for the microphone of first sensor device 1*a*1 as compared to the fifth specific embodiment.

Figure 7:
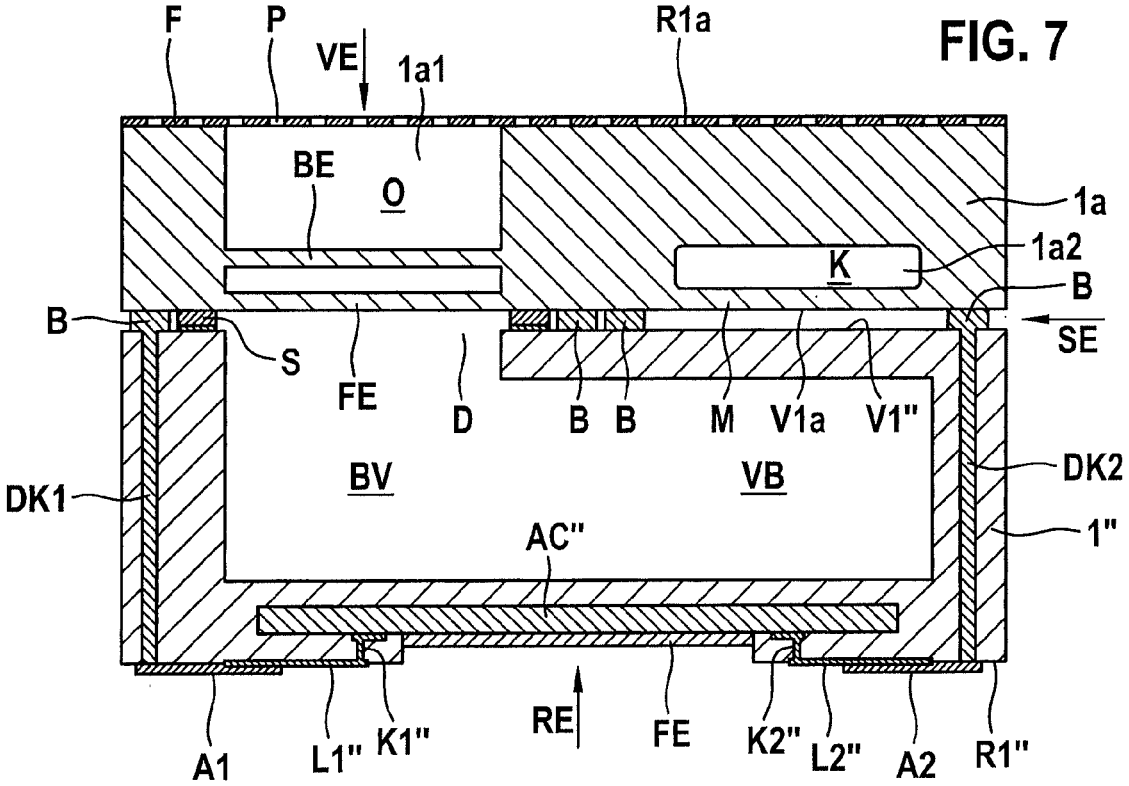
FIG. 7 shows a schematic vertical cross-sectional view of a micromechanical sensor system combination according to a seventh specific embodiment of the present invention.

FIG. 7 shows a schematic vertical cross-sectional view of a micromechanical sensor system combination according to a seventh specific embodiment of the present invention.

In the case of the seventh specific embodiment according to FIG. 7, ASIC chip AC" is also embedded into the lower area of interposer chip 1", humidity sensor FE being exposed here at first back side R1" toward its surroundings, so that the humidity of a surrounding medium is detectable via a back-side access RE.

Figure 8:
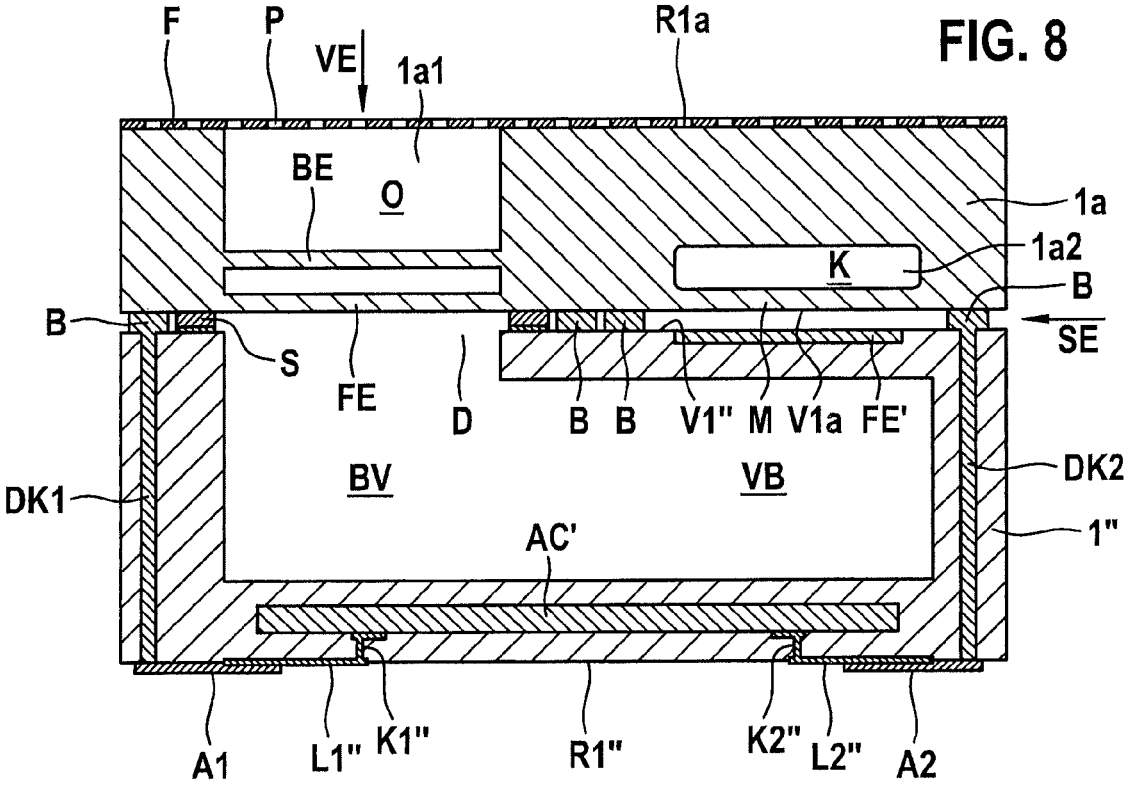
FIG. 8 shows a schematic vertical cross-sectional view of a micromechanical sensor system combination according to an eighth specific embodiment of the present invention.

FIG. 8 shows a schematic vertical cross-sectional view of a micromechanical sensor system combination according to an eighth specific embodiment of the present invention.

In the case of the eighth specific embodiment according to FIG. 8, a third sensor device in the form of a humidity sensor FE' is integrated into first front side V1" of interposer chip 1" underneath diaphragm M of second sensor device 1*a*2 in addition to the third specific embodiment. This humidity sensor FE' is connectable to the surrounding medium via lateral access SE, lateral access SE also being used at the same time as the pressure input for the pressure sensor of second sensor device 1*a*2.

Figure 9:
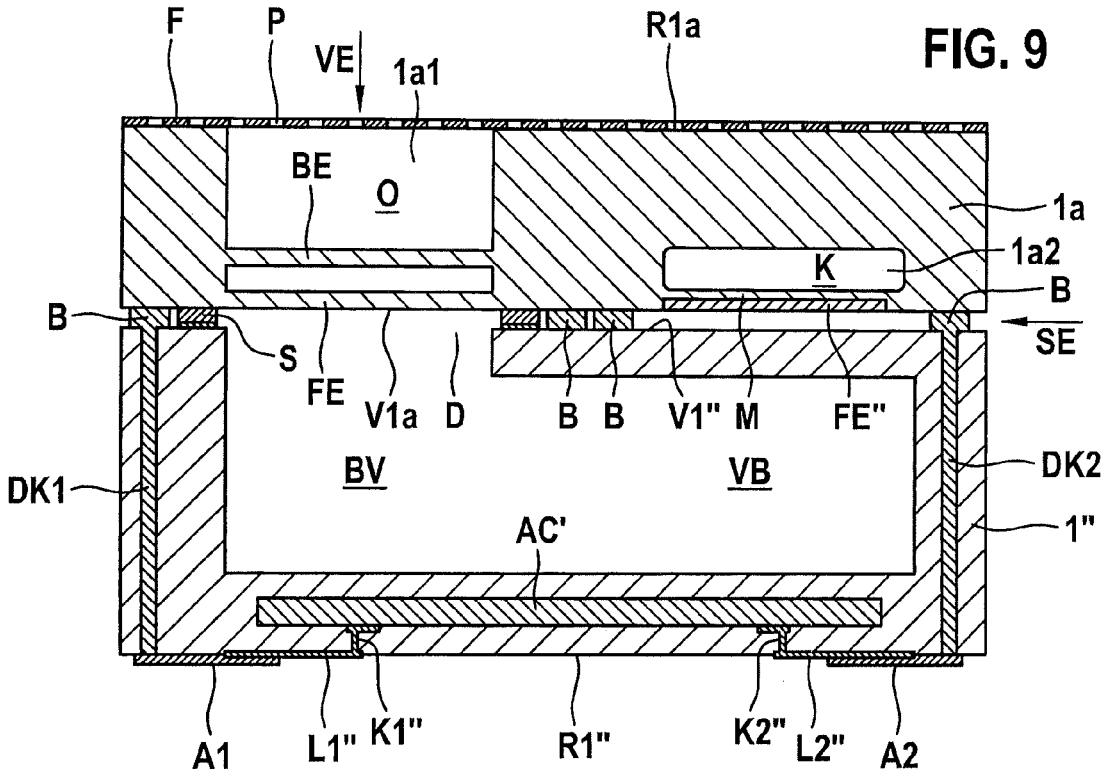
FIG. 9 shows a schematic vertical cross-sectional view of a micromechanical sensor system combination according to a ninth specific embodiment of the present invention.

FIG. 9 shows a schematic vertical cross-sectional view of a micromechanical sensor system combination according to a ninth specific embodiment of the present invention.

In the case of the ninth specific embodiment according to FIG. 9, a third sensor device in the form of humidity sensor FE" is integrated into diaphragm M of second sensor device 1*a*2, to which pressure as well as humidity of the surrounding medium may also be applied via lateral access SE, in contrast to the eighth specific embodiment.

Figure 10:
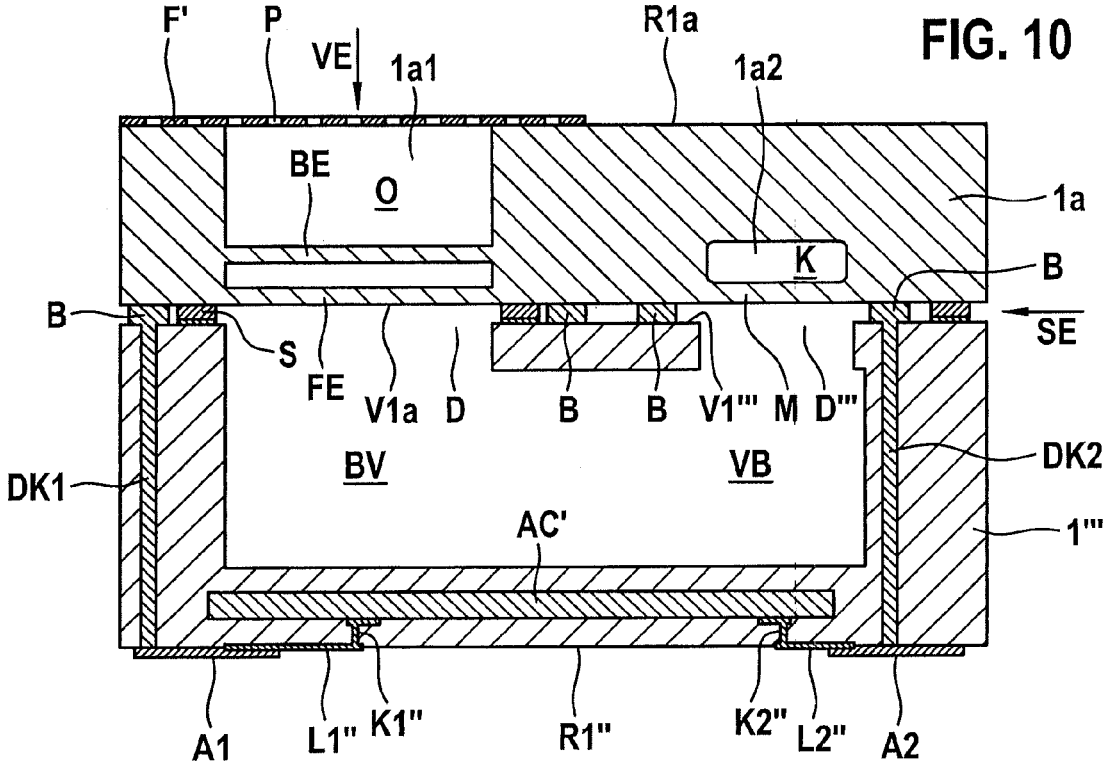
FIG. 10 shows a schematic vertical cross-sectional view of a micromechanical sensor system combination according to a tenth specific embodiment of the present invention.

FIG. 10 shows a schematic vertical cross-sectional view of a micromechanical sensor system combination according to a tenth specific embodiment of the present invention.

In the case of the tenth specific embodiment according to FIG. 10, sound passage opening VE for the microphone of first micromechanical sensor chip system 1*a* is used at the same time as a pressure access opening for the pressure sensor of second sensor device 1*a*2.

For this purpose, interposer chip 1''' including first front side V1''' and first back side R1''' has a further passage opening D'''' on first top side V1''' which connects hollow space BV including widening VB to diaphragm M of the pressure sensor. In this specific embodiment, sealing ring S is configured in such a way that it prevents external medium access to diaphragm M.

Figure 11:
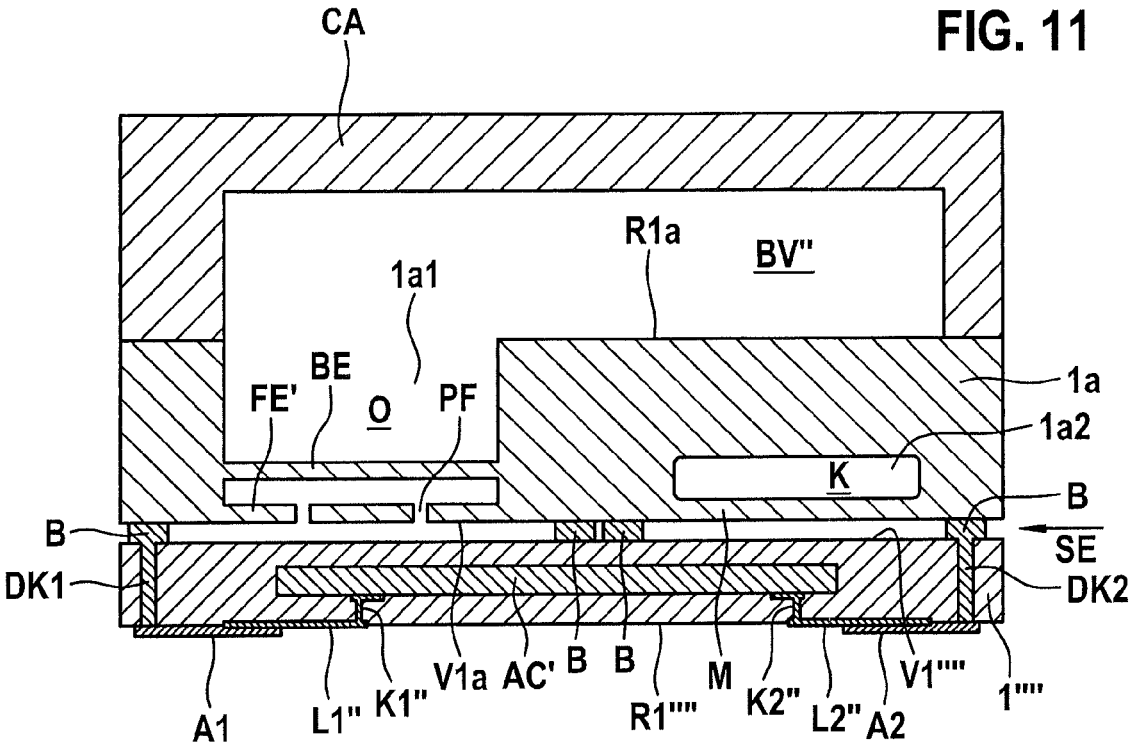
FIG. 11 shows a schematic vertical cross-sectional view of a micromechanical sensor system combination according to an eleventh specific embodiment of the present invention.

FIG. 11 shows a schematic vertical cross-sectional view of a micromechanical sensor system combination according to an eleventh specific embodiment of the present invention.

In the case of the eleventh specific embodiment, interposer chip 1'''' including first front side V1'''' and first back side R1'''' does not have a hollow space, but only an ASIC chip AC' embedded therein, the latter also being completely surrounded by interposer chip 1'''' in this example.

Micromechanical sensor chip system 1*a* which is bonded on interposer chip 1'''' is almost identical to the sensor chip system according to the first specific embodiment, stationary electrode FE' having perforations PF in this case. In the case of the eleventh specific embodiment, these perforations PF allow for a switching access to be implemented via lateral access SE.

In the case of the eleventh specific embodiment, a cover CA having a hollow space BV" is additionally bonded on second back side R1*a* of micromechanical sensor chip system 1*a*. In the case of the eleventh specific embodiment, recess O as well as hollow space BV" of cover CA is used as the back volume of the microphone of first sensor device 1*a*1.

Figure 12:
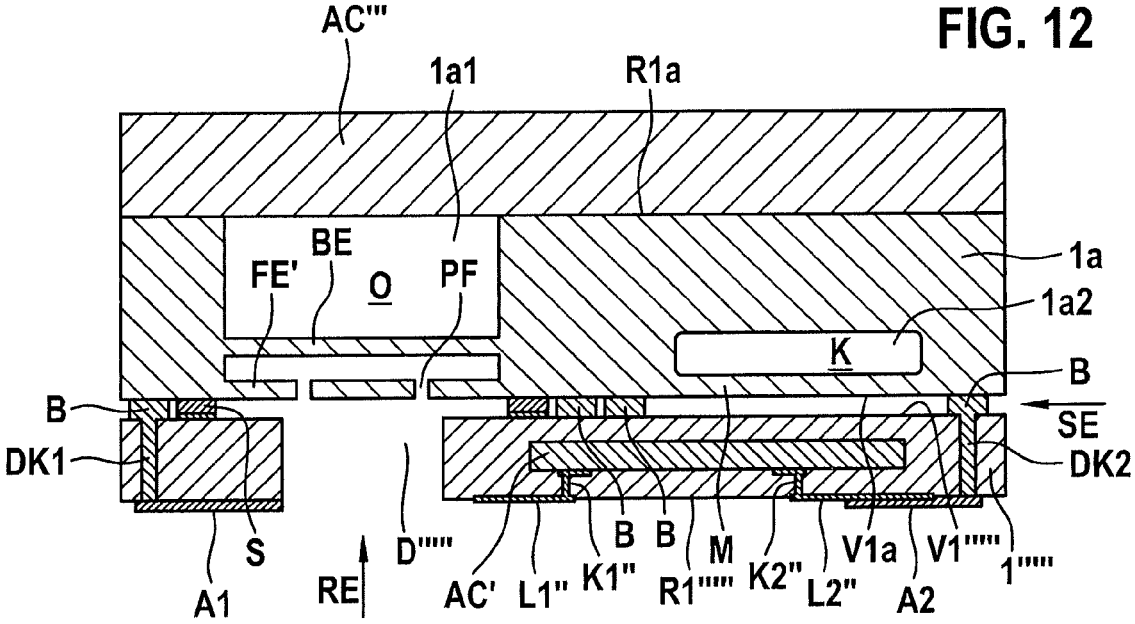
FIG. 12 shows a schematic vertical cross-sectional view of a micromechanical sensor system combination according to a twelfth specific embodiment of the present invention.

FIG. 12 shows a schematic vertical cross-sectional view of a micromechanical sensor system combination according to a twelfth specific embodiment of the present invention.

The twelfth specific embodiment according to FIG. 12 differs from the eleventh specific embodiment in that instead of cover CA, an ASIC chip AC'" is bonded on second back side R1*a* of sensor chip system 1*a* which closes off recess O in such a way that the latter is used as the back volume of the microphone of first sensor device 1*a*1.

In this case, a passage opening D'''' which runs through the entire interposer chip 1'''' from its first front side V1'''' to its first back side R1'''' is used as sound passage opening RE. ASIC chip AC' which is embedded into interposer chip 1'''' is accordingly narrowed laterally.

Although the present invention has been described above to its full extent with reference to exemplary embodiments, it is not limited thereto, but is modifiable in many ways.

In particular, the shown geometries and materials are used only as examples and may be varied almost arbitrarily depending on the application.

The design of the sound transducer in the MEMS chip and the systems in the ASIC chip are used only as examples and may also be varied depending on the application.

Although the micromechanical sensor system combination according to the present invention has been explained above based on sensor combinations which include a microphone and a pressure sensor, the present invention is not limited thereto either, but is also applicable to other sensor combinations.

What is claimed is:

1. A micromechanical sensor system combination, comprising:

an interposer chip including a first front side and a first back side which includes first electrical contacts on the first front side and second electrical contacts on the first back side, wherein the interposer chip has first electrical vias which electrically connect the first electrical contacts to the second electrical contacts; and a micromechanical sensor chip system including a second front side and a second back side including at least one first sensor device and a second sensor device which are laterally adjacent, wherein the first front side is attached on the second front side so that the first sensor device and the second sensor device are electrically and mechanically connected to the first electrical contacts, wherein a further chip is situated within the interposer chip, wherein the further chip is embedded at least partially into the interposer chip and the interposer chip has second electrical vias which electrically connect the further chip to the second electrical contacts, wherein at least one of the second electrical vias is connected to at least one of second electrical contacts via a printed conductor, and at least one of the second electrical vias is directly connected to at least one of second electrical contacts.

2. The micromechanical sensor system combination of claim 1, wherein the further chip is an ASIC chip.

3. The micromechanical sensor system combination of claim 1, wherein the further chip has a third sensor device.

4. The micromechanical sensor system combination of claim 3, wherein the third sensor device is exposed with regard to a surrounding medium.

5. The micromechanical sensor system combination as recited in one of the preceding claims, wherein the interposer chip has a hollow space including a first passage opening which is closed off by the first sensor device.

6. The micromechanical sensor system combination of claim 3, wherein the hollow space has a lateral widening which extends underneath the second sensor device.

7. The micromechanical sensor system combination of claim 1, wherein the second sensor device is exposed with regard to a surrounding medium by a lateral access which is present between the first front side and the second front side.

8. The micromechanical sensor system combination of claim 1, wherein the first sensor device includes a sound transducer and the sensor chip system has a recess on the side facing away from the interposer chip.

9. The micromechanical sensor system combination of claim 8, wherein the recess is a sound passage opening for the sound transducer.

10. The micromechanical sensor system combination of claim 8, wherein a second passage opening is provided in the interposer chip as a sound passage opening for the sound transducer.

11. The micromechanical sensor system combination of claim 1, wherein the first sensor device and the second sensor device are integrated on a single sensor chip.

12. The micromechanical sensor system combination of any of claim 1, wherein: a first passage opening of a hollow space is closed off by the first sensor device; a second passage opening is closed off by the second sensor device; and the hollow space is in the interposer chip.

13. The micromechanical sensor system combination of claim 1, wherein:

a first passage opening of a hollow space is closed off by the first sensor device;

the hollow space is in the interposer chip; and a lateral widening of the hollow space extends underneath the second sensor device, the lateral widening being within the interposer chip.

14. The micromechanical sensor system combination of claim 13, wherein the first sensor device is a sound transducer.

15. The micromechanical sensor system combination of claim 1, further comprising:

a sealing ring that surrounds, and, in combination with the first sensor device, closes off, a first passage opening of a hollow space;

the hollow space is in the interposer chip; and a lateral widening of the hollow space extends underneath the second sensor device, the lateral widening being within the interposer chip.

* * * * *